US010466609B2

(12) United States Patent
Portnoy et al.

(10) Patent No.: US 10,466,609 B2
(45) Date of Patent: Nov. 5, 2019

(54) EMPTY SEPARATION PRINTING

(71) Applicant: HP INDIGO B.V., Amstelveen (NL)

(72) Inventors: Vitaly Portnoy, Ness Ziona (IL); Yoav Nachmias, Ness Ziona (IL); Michel Assenheimer, Kfar Sava (IL); Liran Fanny Haim, Ness Ziona (IL)

(73) Assignee: HP Indigo B.V., Amstelveen (NL)

( * ) Notice: Subject to any disclaimer, the term of this patent is extended or adjusted under 35 U.S.C. 154(b) by 0 days.

(21) Appl. No.: 16/072,288

(22) PCT Filed: May 9, 2016

(86) PCT No.: PCT/EP2016/060320
§ 371 (c)(1),
(2) Date: Jul. 24, 2018

(87) PCT Pub. No.: WO2017/194086
PCT Pub. Date: Nov. 16, 2017

(65) Prior Publication Data

US 2019/0033744 A1 Jan. 31, 2019

(51) Int. Cl.
*G03G 15/00* (2006.01)
*G03G 15/01* (2006.01)
(Continued)

(52) U.S. Cl.
CPC ..... *G03G 15/0121* (2013.01); *G03G 15/10* (2013.01); *G03G 15/101* (2013.01); *G03G 15/50* (2013.01); *G03G 21/0094* (2013.01)

(58) Field of Classification Search
USPC ..... 399/39, 296
See application file for complete search history.

(56) References Cited

U.S. PATENT DOCUMENTS 5,066,988 A 11/1991 Miyake
2007/0019996 A1* 1/2007 Romem ..... G03G 15/161 399/296

(Continued)

FOREIGN PATENT DOCUMENTS

WO WO-2006090352 8/2006
WO WO-2016020015 2/2016

OTHER PUBLICATIONS

Anthony, Thomas C., et al. "ElectroInk Charge Retention in the HP Indigo LEP Press." NIP & Digital Fabrication Conference. vol. 2012. No. 2. Society for Imaging Science and Technology, 2012.

*Primary Examiner* — Quana Grainger
(74) *Attorney, Agent, or Firm* — Michael A Dryja

(57) ABSTRACT

An apparatus is provided for controlling a liquid electrophotography printer (LEP). The LEP may include a plurality of ink developers, IDs, to transfer charged ink to a photoreceptor, by virtue of a potential difference between the engaged ID and the photoreceptor selectively dischargeable to allow an image to be formed on a print medium in use through printing a spread of plural color separations thereon each corresponding to ink from one of a plurality of engaged IDs. the apparatus may comprise a print controller to, in use monitor an order of color separations to be printed onto the print medium. The print controller may also detect in the order of color separations an empty separation of an ID followed by a printing separation of the same ID, an empty separation representing a separation in which no image is formed on the photoreceptor and the engaged ID is at a voltage different to the voltage of the ID for a printing separation so as to, in the empty separation, substantially wet the photoreceptor and substantially not transfer ink thereto. The print controller may also, in response to the (Continued)

detection, replace in the order of the color separations the ID for the empty separation with a different ID.

19 Claims, 5 Drawing Sheets

(51) Int. Cl.
*G03G 15/10* (2006.01)
*G03G 21/00* (2006.01)

(56) References Cited

U.S. PATENT DOCUMENTS

2009/0279911 A1 11/2009 Raz et al.
2015/0071665 A1 3/2015 Lam et al.

* cited by examiner

EMPTY SEPARATION PRINTING

BACKGROUND

Electro-photography (EP) printing devices form images on print media by placing a uniform electrostatic charge on a photoreceptor and then selectively discharging the photoreceptor in correspondence with the images. The selective discharging forms a latent electrostatic image on the photoreceptor. Colorant is then developed onto the latent image of the photoreceptor, and the colorant is ultimately transferred to the media to form the image on the medium. In dry EP (DEP) printing devices, toner is used as the colorant, and it is received by the media as the media passes below the photoreceptor. The toner is then fixed in place as it passes through heated pressure rollers. In liquid EP (LEP) printing devices, ink is used as the colorant instead of toner. In LEP devices, an ink image developed on the photoreceptor is offset to an image transfer element, where it is heated until the solvent evaporates and the resinous colorants melt. This image layer is then transferred to the surface of the print media being supported on a rotating impression drum.

Non-productive print cycles may be used during various stages of the print process. During non-productive print cycles, images are not being written to the photoreceptor or transferred to the image transfer element. The lack of image transfers during such non-productive cycles can damage the image transfer element and reduce print quality.

BRIEF DESCRIPTION OF THE DRAWINGS

Various examples are described herein with reference to the accompanying drawings, in which.

DETAILED DESCRIPTION

The following description provides illustrative examples of an apparatus and printing process associated with an LEP printing process. The examples however are presented for the purpose of illustration rather than limitation, and may therefore be applicable to printing processes other than the LEP printing process described below.

Figure 1:
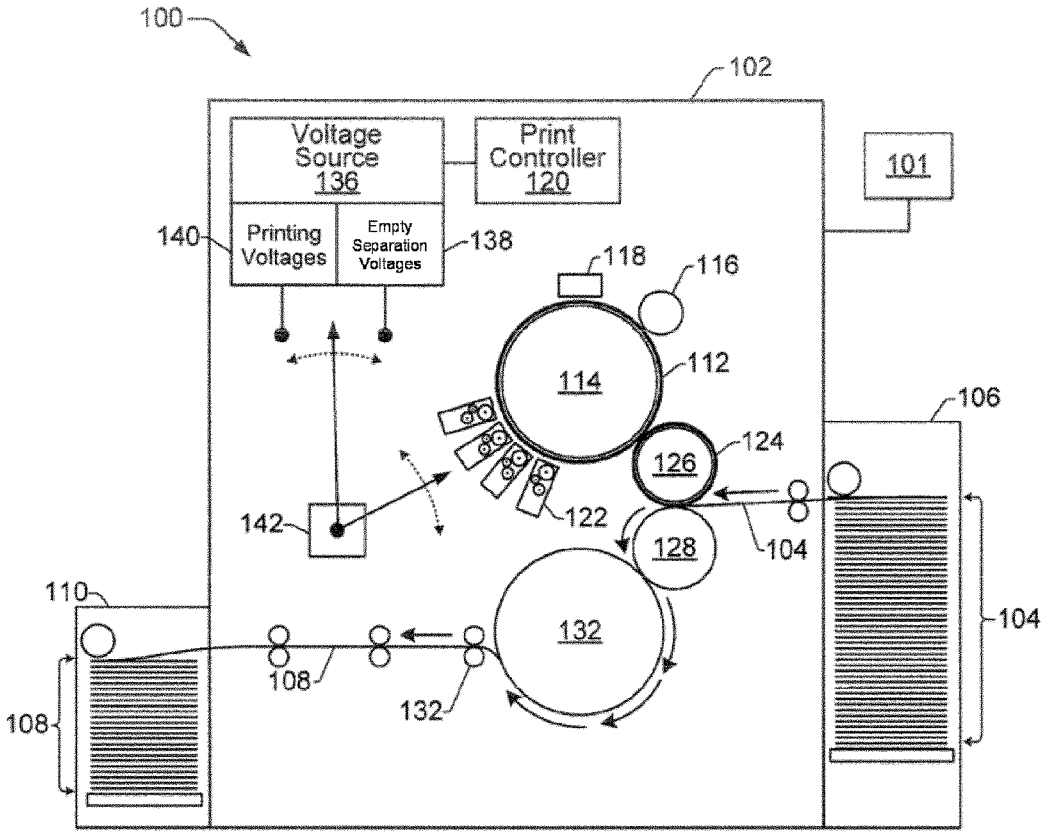
FIG. 1 shows an example of a printing device suitable for selecting an ink developer (ID) to perform empty separation non-productive print cycles.

FIG. 1 illustrates an example of a printing device 100 suitable for selecting an ink developer (ID) to perform empty separation non-productive print cycles. The printing device 100 comprises a print-on-demand device, implemented as a LEP printing press 100. A LEP printing press 100 generally includes a user interface 101 that enables the operator to manage various aspects of printing, such as reviewing print jobs, inputting media definitions, setting calibrations, performing maintenance, reviewing the order of the print jobs, and so on. The user interface 101 typically includes a touch-sensitive display screen that allows the operator to interact with information on the screen, make entries on the screen, and generally control the press 100. The user interface 101 may also include other devices such as a key pad, a keyboard, a mouse, and a joystick, for example.

An LEP printing press 100 includes a print engine 102 that receives a print substrate, illustrated as print medium 104 (e.g., cut-sheet paper) from a media input mechanism 106. After the printing process is complete, the print engine 102 outputs the printed medium 108 to a medium output mechanism, such as a medium stacker tray 110. The printing process is generally controlled by a print controller 120 to generate the printed medium 108 using digital image data that represents words, pages, text, and images that can be created, for example, using electronic layout and/or desktop publishing programs. Digital image data is generally formatted as one or multiple print jobs that are stored and executed on the print controller 120, as further discussed below with reference to FIG. 2.

The print engine 102 includes a photo imaging component, such as a photoreceptor 112 mounted on a photoreceptor/imaging drum/cylinder 114. The photoreceptor 112 defines an outer surface of the imaging drum 114 on which images can be formed. The photoreceptor 112 may coated onto the imaging drum 114, or it may be provided by foil wrapped around the drum 114. A charging component such as charge roller 116 generates electrical charge that flows toward the photoreceptor surface and covers it with a uniform electrostatic charge. The print controller 120 uses digital image print data and other inputs such as print job and print media parameters, temperatures, and so on, to control a writing head, in this case laser imaging unit 118, to selectively expose the photoreceptor 112 in a pattern consistent with the digital image print data. The laser imaging unit 118 exposes image areas on the photoreceptor 112 by dissipating (neutralising) the charge in those areas. Exposure of the photoreceptor in this manner creates a 'latent image' in the form of an invisible electrostatic charge pattern that replicates the image to be printed.

In LEP, the printing process may comprise three transfers of ink, referred to as zero, first and second transfers. The zero transfer is from an ink developer, ID, 122 to the photoreceptor 112. The first transfer is from the photoreceptor 112 to an ITM drum 126. The second transfer is from the ITM drum 126 to the IMP drum 128 on which a substrate such as a print medium 104 mounted.

In the zero image transfer, after the latent electrostatic image is formed on the photoreceptor 112, the image is developed thereon by engaging an ID 122 containing charged liquid ink of an appropriate colour to develop ink onto the latent electrostatic image on the photoreceptor 112 and form an ink image on the outer surface of the photoreceptor 112.

In the zero transfer, the ID 122 performs three functions: ink development, ink transfer to the photoreceptor 112 and residual ink removal. Each ID 122 includes several components including rollers and electrodes and to which specific voltages are applied to perform these functions. Ink in an ID inlet flows through a gap between the two parts of an electrode until it reaches an ID developer roller. The developer roller within the ID 122 is coated with a layer of charged liquid ink particles and the developer roller engages the surface of the photoreceptor and develops in onto it. Print controller 120 can apply printing voltages 140 from a voltage source 136 to an ID 122 through controlling a voltage application mechanism 142 such as a switch, to differentially charge the electrodes, surfaces and rollers in the ID to voltages, collectively referred to herein as "printing voltages", to create the electric fields between the ID and photoreceptor that enable the development of charged ink from the ID 122 to the latent electrostatic image on the photoreceptor 112. In printing a colour separation, the developer roller is at a voltage level in between the maximum and minimum voltage of the photoreceptor 112, and as the developer roller and photoreceptor 112 rotate against one another, different portions of the charged ink layer progressively come into contact with the photoreceptor 112 at a nip between the two rollers. Charged ink on the developer roller is attracted to locations on the photoreceptor 112 where surface charge has been neutralized by the laser, and repelled from locations on the photoreceptor 112 where surface charge has not been neutralised by the laser. This initial transfer of ink from the ID to the photoreceptor 112 that produces a developed ink image on the surface of the photoreceptor 112 is referred to as the 'zero' image transfer. Afterwards, to perform the cleaning function, a cleaner roller cleans residual ink off of ID rollers that does not transfer to the photoreceptor.

Each ID 122 develops one ink colour of the image, and each developed colour corresponds with one image impression or colour printing separation. In an example, the print controller 120, described in more detail below in relation to FIG. 2, receives print jobs to be printed by print engine 102, each print job comprising one or more print spreads that the print controller 120 decomposes the image represented in each spread into plural colour separations each to be developed by one of the IDs 122 of a given colour, onto the photoreceptor 112. While four IDs 122 are shown, indicating a four colour process (i.e. a CMYK process), other press implementations may include additional IDs 122 corresponding to additional colours (for example, seven IDs may be provided). In addition, although not illustrated, print engine 102 also includes erase and cleaning mechanisms that are generally incorporated as part of any electrophotographic process.

In the example, in a subsequent 'first' image transfer, the single colour separation impression of the ink image developed on the photoreceptor 112 is transferred from the photoreceptor 112 to an image transfer blanket 124. The image transfer blanket 124 is primarily referred to herein as the print blanket 124 or blanket 124. The print blanket 124 is wrapped around and securely fastened to the outer surface of the intermediate transfer member (ITM) drum 126. The first image transfer that transfers ink from the photoreceptor 112 to the print blanket 124 is driven by an applied mechanical pressure between the imaging drum 114 and the ITM drum 126, and electrophoresis of the electrically charged ink particles. The electric field that drives the ink transfer is created by a bias voltage applied to the print blanket 124. Both the blanket bias voltage and the mechanical pressure between the imaging drum 114 and ITM drum 126 can impact the image transfer quality.

The print blanket 124 may be heated by both internal and external heating sources such as infrared heating lamps (not shown). The heated print blanket 124 causes most of the carrier liquid and solvents in the transferred ink image to evaporate. The heated blanket 124 also causes the solid particles in the ink to partially melt and blend together. This results in a finished ink image on the blanket 124 in the form of a hot, nearly dry, tacky plastic ink film.

In the example, in a 'second' image transfer, this hot ink film image impression is then transferred from the blanket 124 to a substrate such as a sheet of print media 104 (e.g., sheet or web paper), which is held or supported by an impression (IMP) drum/cylinder 128. Contact pressure between the ITM drum 126 and IMP drum 128 compresses the blanket 124 against the print media 104 to facilitate the transfer of the hot ink film image. The temperature of the print media 104 is below the melting temperature of the ink particles, and as the ITM drum 126 and IMP drum 128 rotate against one another under pressure, the hot ink film comes into contact with the cooler print medium 104 and causes the ink film to solidify and peel off from the blanket 124 onto the print medium 104.

This process is repeated for each colour separation in the image. In a 4-shot printing process, the colours accumulate in successive revolutions on the print media 104 wrapped on the impression drum 128 until all the colour separation impressions (e.g., C, M, Y, and K) in the image are transferred to the print media 104. After all the colour impressions have been transferred to the sheet of print media 104, the printed media 108 sheet is transported by various rollers 132 from the impression drum 128 to the output mechanism 110. In a 1-shot printing process, the colour separations accumulate on the print blanket 124 and are transferred to the print media at one time after all the colour separations have been transferred to the blanket.

As described above, the colour printing separations represent productive print cycles in which an ID 122 is engaged with the imaging drum 114 and has printing voltages from printing voltage source 140 applied thereto by voltage application mechanism 142, and in which a latent image is formed on the photoreceptor 112 so as to cause ink to be developed from the engaged ID 122 onto the photoreceptor 112 for transfer on to the print media 104.

In examples, the printing device 100 may in certain circumstances perform non-productive, empty separation printing cycles during the printing process for various reasons. Empty separations are printed under substantially the same printing conditions as a regular or 'colour' printing separation which includes ink transfer, the main difference is that, in empty separation print cycles, no image is created on the photoreceptor 112 and substantially no ink is transferred thereto. One reason an empty separation may be used is that an extra drying cycle can be used for the ink to dry before transferring it to the substrate. A second reason an empty separation is used is to, in certain circumstances, heat the substrate, the substrate may be provided on the IMP drum 128 for at least one cycle to heat it while it is on an IMP drum 128 before the ink transfer begins. A third reason an empty separation may be used is to delay a transfer, for example transferring to a conductive substrate where it may in certain cases be necessary to turn off the high-voltage on the ITM drum 126. There may be further reasons why empty separation printing is used.

If, during empty separations, the voltage applied to the ID 122 is the same as for printing separations (i.e. from printing voltages 140 source), a small amount of ink is still developed on the ID developer roller. Although no image exists on the photoreceptor 112, some ink is still transferred to the photoreceptor 112 from the ID 122, this is called background. During an empty separation therefore, there is background transfer which is undesirable due to ink consumption and possible print quality side effects. There is also imaging oil transfer from the ID 122 to the photoreceptor 112 which is for keeping the blanket wet, minimising current during transfer from the imaging drum 114 to ITM drum 126 and avoiding back transfer from the blanket to the photoreceptor 112. Dropping the developer roller voltage to zero during an empty separation is not desirable however due to the time for an ID 122 to reach the set voltage.

If instead selected empty separation voltages 138 provided by voltage source 136 are applied to the ID 122 for empty separations, substantially no ink is developed on the developer roller and therefore substantially no background transferred between the ID 122 and photoreceptor 112.

Voltage source 136 is thus intended to represent a plurality of sources that provide individual voltages to the ID for differentially electrically charging surfaces and several rollers within the ID, including at printing voltages 140 or empty separation voltages 138. Accordingly, the voltage application mechanism 142 can include a plurality of application mechanisms suitable for applying individual voltages within the ID. For example, voltage application mechanism 142 may accommodate differences in timing while changing the individual voltages within the ID when transitioning back and forth between colour printing separation voltages 140 and empty separation voltages 138.

Selected empty separation voltages are different from printing voltages and therefore transitions from printing to empty separation voltages and vice versa exist. Transitions from empty separation voltages to printing separations however cannot easily be performed in the time between consecutive separations. This is because, to achieve good print quality, the printing voltages are to be prepared and stabilised in a sufficient amount of time before printing. To make the transition from empty separation voltages to printing voltages, firstly the empty separation voltages may be turned off on the ID 122 or the voltages applied to the ID 122 changed such that the printing voltages can be built up on the ID 122. Where there is a time constraint in modifying the voltage of the ID 122 in this way, this can create difficulties with achieving a desired print quality. In practice, there are circumstances in which these time constraints can arise.

For example, Yellow-Magenta-Cyan-Black-White-White printing (YMCKWW) (also referred to as 'White-White' printing) is a common colour separation order in labels & packaging. The white ink transferred to the substrate may be desirably of a high opacity and therefore a repetition of the white ink transfer may be performed to achieve such a high opacity. However, a special drying policy may be advisable in these circumstances to avoid print quality issues such as cracks and wetness. This drying policy may use an empty separation before and after printing a white separation, furthermore this empty separation should be performed by an available ID other than white. During white-white printing, a yellow ID is generally selected as its background is the least visible. As described above, it may be desirable to use different voltages for empty separations to substantially eliminate the background, but by doing so the use of a yellow ink developer for the empty separation may cause difficulties because two consecutive spreads would look like YMCKY'WY'WY'-YMCKYWY'WY' (where Y' is an empty separation). This would result in Y'-Y printing, i.e. consecutive empty separation printing and then colour separation printing using the same yellow ID. This creates a time constraint in modifying the voltage of the ID 122 from the empty separation voltages to printing voltages and this would unfeasible without inserting extra null cycles to allow sufficient time for the ID to transition from the empty separation voltage to be ready to perform printing separations. Inserting extra dry null cycle harms utilisation and has a negative impact on the life span of consumables. A similar time constraint may also arise when performing 'pre'-empty separations and 'post'-empty separations using a Yellow ID in YMCK printing.

Figure 2:
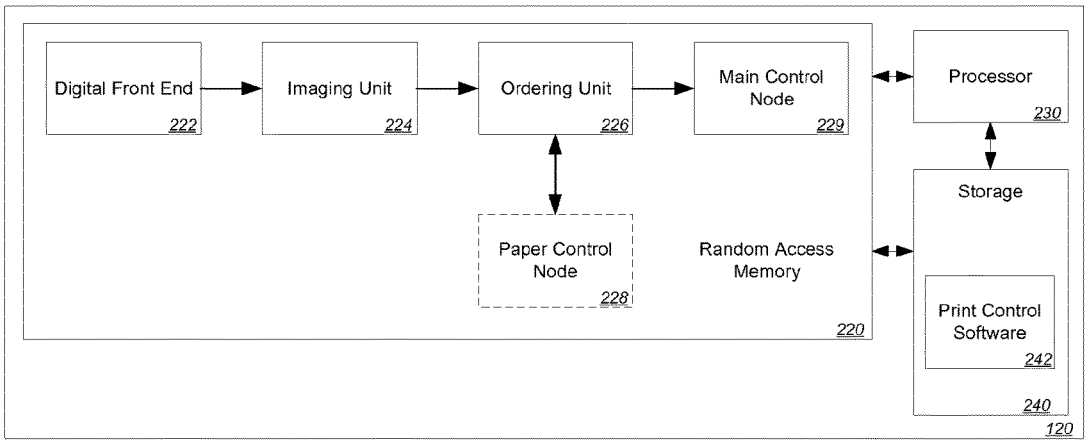
FIG. 2 shows a box diagram of an example print controller suitable for use within an LEP printing press.

An example print controller 120 for addressing this will now be described in more detail with reference to FIG. 2. FIG. 2 shows a box diagram of an example print controller 120 suitable for use within a LEP printing press. The print controller 120 comprises random access memory (RAM) 220, at least one processor 230 and storage 240. Each of the RAM 220, processor 230 and storage 240 are coupled to one another by means of a parallel or serial bus, or any other interconnect for the transfer of data. The storage 240 further comprises print control software 242 which may be transferred to the RAM 220 for execution by the processor 230. The diagram illustrates the modules of this software in the RAM 220.

The RAM 220 comprises a digital front end (DFE) 222, coupled to an imaging unit 224. The DFE 222 comprises a memory to store printing jobs. The imaging unit 224 is also coupled to the ordering unit 226. The ordering unit 226 is further coupled the paper control node 228 and main control node 229.

After raster image processing is performed, print jobs are stored in the DFE 222 and ready to be sent for printing. A print job comprises the print data regarding the image to be printed. The imaging unit 224 takes at least one job from the DFE 222, retrieves information spread by spread, imposes constraints, such as empty separations and image placement. Each spread comprises a plurality of colour separations. This information is then sent to the ordering unit 226 to create the right ordering, before sending this information to the MCN 229. In sheet-fed presses, as opposed to web-fed machines, the ordering in sheet-fed presses is performed by the Paper Control Node (PCN) 228.

The print controller 120, or one or more components thereof, may be implemented purely in either software or hardware, or furthermore a combination of the two. It should also be appreciated that the print controller does not have to reside inside the printing device 100, and may be located externally but in communication with the printing device.

The print controller 120, or one or more components thereof operating individually or in combination, is provided to, in use, monitor an order of colour separations to be printed onto the print medium and detect in the order of colour separations an empty separation of an ID followed by a printing separation of the same ID. In response to the detection, the print controller 120, or one or more components thereof operating individually or in combination, is provided to replace in the order of the colour separations the ID for the empty separation with a different ID. The print controller 120 thus operates to ensure that the print engine 102, when performing non-productive empty separation print cycles with an ID at an empty separation voltage different to a print voltage for a productive print cycle, is not followed immediately by a colour separation using the same ID that was used in the preceding empty separation. This will now be described in more detail with reference to examples.

Figure 3:
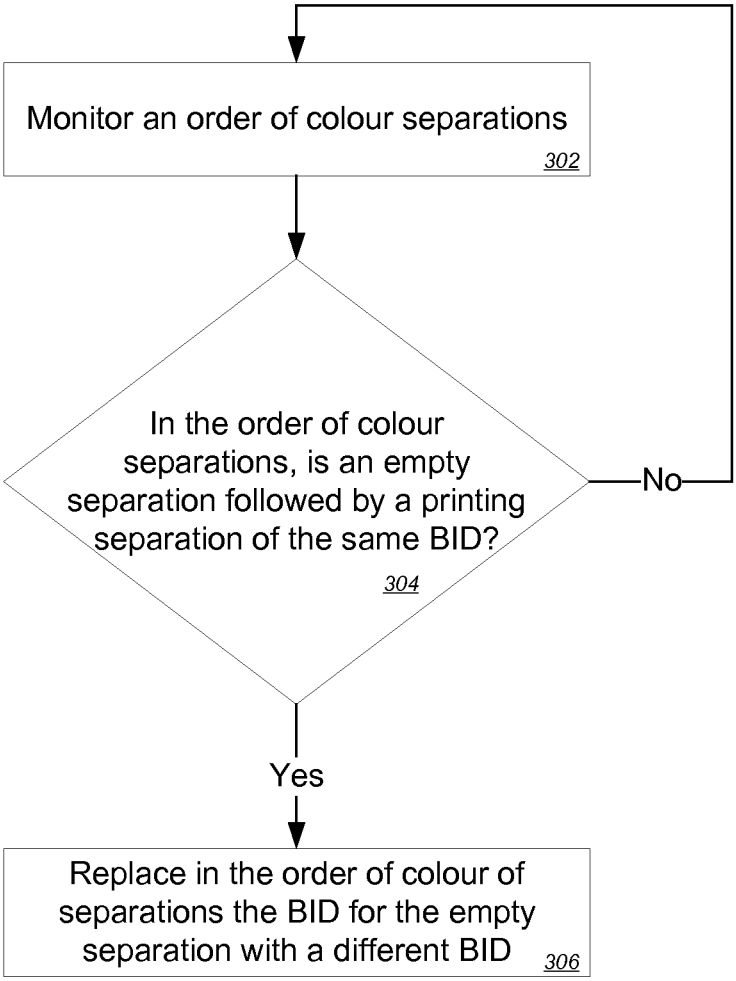
FIG. 3 shows a flow diagram illustrating an example process of selecting an ID for use in an empty separation.

An example process of selecting an ID for use in an empty separation in accordance with examples of the present disclosure will now be described in more detail with reference to FIG. 3. In 302, the print controller 102 monitors an order of colour separations to be printed onto the print medium. The size of the order of colour separations monitored is at least two in order to detect empty separation followed by a printing separation.

In 304, the print controllers detects if in the order of colour separations an empty separation of an ID followed by a printing separation of the same ID, an empty separation representing a separation in which no image is formed on the photoreceptor and the ID is engaged at a different voltage than in the printing separation. This is to in the empty separation substantially wet the photoreceptor and substantially not transfer ink thereto. If this is not detected, the print controller continues to monitor the order of colour separations in 302.

If in 304, it is detected that there is an empty separation followed by a printing separation of the same ID, the print controller proceeds to 306. In 306, the print controller replaces in the order of colour separations the ID for the empty separation with a different ID. In examples, the selection of an ID for use in an empty separation may be dependent on the time period for stabilising a voltage of an ID from the empty separation voltage to the colour separation voltage.

Figure 4:
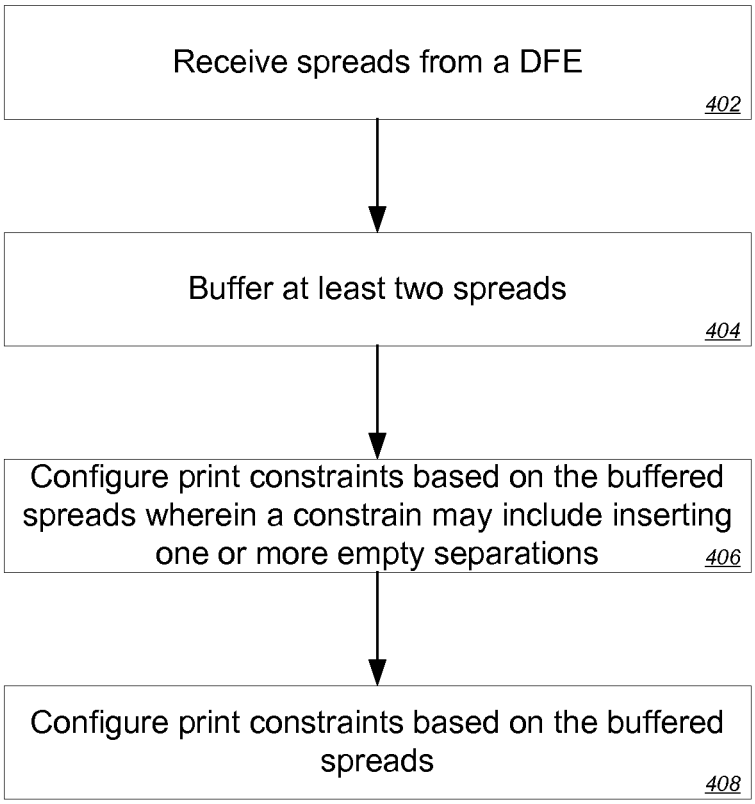
FIG. 4 shows a flow diagram illustrating an example implementation in an imaging unit of the process of selecting an ID for use in an empty separation.

FIG. 4 illustrates an implementation of the process of selecting an ID for use in an empty separation in the imaging unit 224 of the print controller 102. In 402 the imaging unit 224 receives spreads from the DFE 222. In 404, the imaging unit 224 is to buffer separations corresponding to at least two spreads of one or more print jobs. In one example, the imaging unit is to buffer two spreads at the same time, and therefore ascertain that there is no chance of the same ID performing printing immediately after an empty separation. This is achieved in 406 wherein print constraints are configured based on the buffered spreads wherein a constraint may include inserting one or more empty separations. The DFE 222 may also impose print constraints such as, but not limited to image placement. In 408, the imaging unit 224 may then selectively replace the ID of the empty separations in the buffer.

Figure 5:
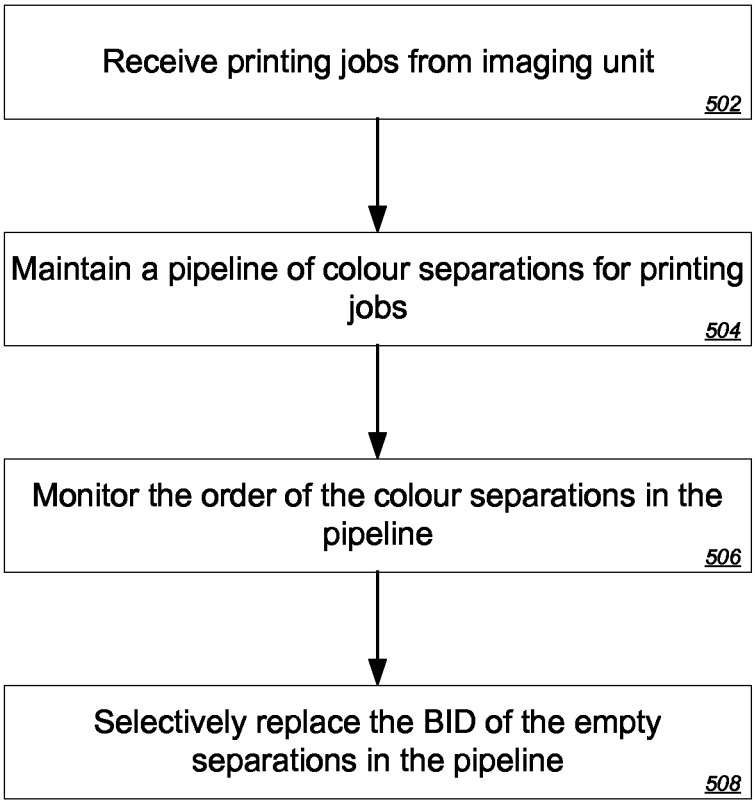
FIG. 5 shows a flow diagram illustrating an implementation in a main control node (MCN) of an example process of selecting an ID for use in an empty separation.

FIG. 5 illustrates an implementation of the process of selecting an ID for use in an empty separation in the MCN 229 of the print controller 102. In 502 the MCN receives colour separations from the imaging unit 502. In 504, the MCN 229 maintains a pipeline of colour separations for printing jobs. This pipeline comprises at least two spreads. In 506 the MCN 229 monitors the order of the colour separations in the pipeline. This is in order to track situations where empty separation to print separations may occur. In 508 the MCN 229 selectively replaces the ID of the empty separations in the pipeline.

Figure 6A:
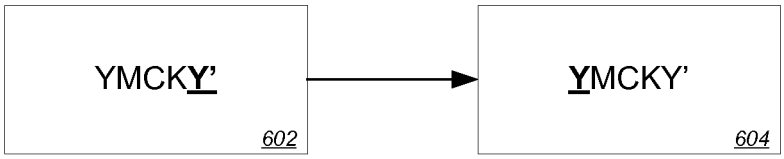
FIGS. 6A, 6B & 6C illustrate example spreads which include empty separations.
Figure 6B:
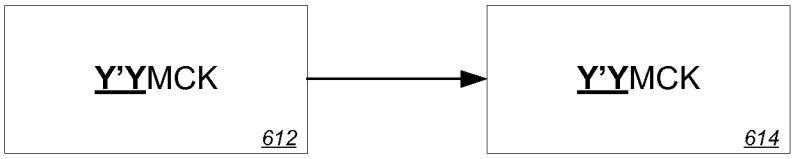
Figure 6C:
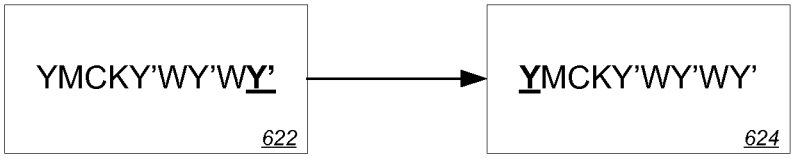

FIGS. 6A, 6B, & 6C illustrate possible scenarios where empty separations may occur and in which the print controller 120 may operate to ensure that empty separation print cycles with an ID 122 are not followed immediately by a colour separation using the same ID 122. FIG. 6A shows where a 'post'-empty separation is performed. In this scenario the YMCK print process is used in two consecutive spreads. The post-empty separation between the spreads may be needed in order to reduce wetness or cracks on the print medium. In the first spread 602, the Y ID is selected to perform the empty separation. This however does not take into account that the Y' ID is also the first ID in the subsequent second spread 604, hence leading to Y'Y occurring.

FIG. 6B shows where a pre-empty separation is performed. In this scenario the YMCK print process is used in two consecutive spreads. The pre-empty separation between the spreads may be needed to heat the print medium before ink transfer. In the first spread 612 and second spread 614, the Y' ID is selected to perform the empty separation. This however does not take into account that the first colour separation of each spread is Y, hence leading to two instances of Y'Y occurring.

FIG. 6C shows where a white policy empty separation is performed. In this scenario, the YMCKWW printing process is used in two consecutive spreads. The white policy empty separation performed before and after each of the white colour separations is performed to reduce wetness and cracks on the print medium. In the first 622, the Y' ID is selected to perform the empty separation after the last white colour separation. This however does not take into account that the Y' ID is also the first ID in the subsequent second spread 624, hence leading to Y'Y occurring.

Therefore, in the examples given in FIGS. 6A, 6B & 6C, to avoid needing to insert a null cycle between the two spreads to account for the time it takes to adjust from the empty separation voltages to the printing voltages, the print controller 120 operates to replace the Y' ID used for the empty separation with that of a different ID (e.g. M', C', K') to that of the subsequent ID.

Throughout the description and claims of this specification, the words "comprise" and "contain" and variations of them mean "including but not limited to", and they are not intended to (and do not) exclude other moieties, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

The invention claimed is:

1. An apparatus for controlling a liquid electrophotography printer comprising a plurality of ink developers, IDs, to transfer charged ink to a photoreceptor, the apparatus comprising a print controller to:

monitor an order of color separations within a pipeline of color separations of print jobs to be printed onto the print medium;

detect in the order of color separations an empty separation of an ID followed by a printing separation of the same ID, an empty separation representing a separation in which no image is formed on the photoreceptor and in which an ID is engaged with the photoreceptor and is at a voltage different than the voltage of the ID for a printing separation so as to, in the empty separation, substantially wet the photoreceptor and substantially not transfer ink thereto; and in response to the detection, replace in the order of the color separations the ID for the empty separation within the pipeline with a different ID.

2. The apparatus of claim 1 wherein the selection of an ID for use in an empty separation is dependent on the time period for stabilizing a voltage of an ID from the empty separation voltage to the color separation voltage.

3. The apparatus of claim 1 wherein the print controller comprises an imaging unit to manage print job requirements and to deliver print jobs to a main control node, MCN, for printing, the imaging unit to:

receive in the imaging unit separations corresponding to spreads from a digital front end, DFE;

store separations corresponding to at least two spreads; and configure print constraints based on the stored spreads;

wherein a constraint includes inserting one or more empty separations into the color separations of a spread.

4. The apparatus of claim 3 wherein the imaging unit is to monitor the order of the color separations in a buffer of separations corresponding to at least two spreads to selectively replace the ID of the empty separations in the buffer.

5. The apparatus of claim 3 wherein the DFE comprises a memory to store printing jobs.

6. The apparatus of claim 1 wherein the print controller comprises a main control node, MCN, to operate the printer to print jobs received from an imaging unit, the MCN being to:

maintain the pipeline of color separations for printing the print jobs received from the imaging unit; and monitor the order of the color separations in the pipeline to selectively replace the ID of the empty separations in the pipeline.

7. The apparatus of claim 1 wherein the empty separation is a post-empty separation performed at the end of the spread;

wherein the color separation at the beginning of the subsequent spread is considered when selecting an ID to use in the empty separation.

8. The apparatus of claim 1 wherein the empty separation is a pre-empty separation performed at the beginning of the spread;

wherein the color separation at the beginning of the spread is considered when selecting an ID to use in the empty separation.

9. The apparatus of claim 1 wherein the empty separation is a white policy empty separation performed before and after a white color separation;

wherein the next color separation is considered when selecting an ID to use in the empty separation.

10. A printer comprising the apparatus as claimed in claim 1, the printer further comprising a writing head to selectively discharge areas of the photoreceptor to allow an image to be formed.

11. The printer as claimed in claim 10, the printer further comprising an image transfer blanket affixed to an intermediate transfer member, ITM, wherein the image transfer blanket is to receive ink from the photoreceptor and transfer it to the print medium supported by an impression drum, IMP.

12. A non-transitory computer readable medium comprising instructions that when executed by at least one processor, cause the at least one processor to implement an apparatus for controlling a liquid electrophotography printer comprising a plurality of ink developers, IDs, to transfer charged ink to a photoreceptor, the apparatus comprising a print controller to:

monitor an order of color separations to be printed onto the print medium;

detect in the order of color separations an empty separation of an ID followed by a printing separation of the same ID, an empty separation representing a separation in which no image is formed on the photoreceptor and the engaged ID is at a voltage different than the voltage of the ID for a printing separation so as to, in the empty separation, substantially wet the photoreceptor and substantially not transfer ink thereto; and in response to the detection, replace in the order of the color separations the ID for the empty separation with a different ID;

wherein the empty separation is a white policy empty separation performed before and after a white color separation;

wherein the next color separation is considered when selecting an ID to use in the empty separation.

13. A method for controlling a liquid electrophotography printer comprising a plurality of ink developers, IDs, to transfer charged ink to a photoreceptor, the method comprising:

monitoring an order of color separations to be printed onto the print medium;

detecting in the order of color separations an empty separation of an ID followed by a printing separation of the same ID, an empty separation representing a separation in which no image is formed on the photoreceptor and the engaged ID is at a voltage different to the voltage of the ID for a printing separation so as to, in the empty separation, substantially wet the photoreceptor and substantially not transfer ink thereto; and in response to the detection, replacing in the order of the color separations the ID for the empty separation with a different ID, wherein the selection of an ID for use in an empty separation is dependent on the time period for stabilizing a voltage of an ID from the empty separation voltage to the colour separation voltage.

14. The method of claim 13 implemented in an imaging unit to manage print job requirements and to deliver print jobs to a main control node, MCN, for printing, the method further comprising:

receiving separations corresponding to spreads from a digital front end, DFE;

storing color separations corresponding to at least two spreads; and configuring print constraints based on the stored spreads;

wherein a constraint includes inserting one or more empty separations into the color separations of a spread.

15. The non-transitory computer readable medium of claim 12 wherein the selection of an ID for use in an empty separation is dependent on the time period for stabilizing a voltage of an ID from the empty separation voltage to the color separation voltage.

16. The non-transitory computer readable medium of claim 12 wherein the print controller being further to:

receive separations corresponding to spreads from a digital front end, DFE;

store separations corresponding to at least two spreads; and configure print constraints based on the stored spreads;

wherein a constraint includes inserting one or more empty separations into the color separations of a spread.

17. The non-transitory computer readable medium of claim 12 wherein the print controller being further to:

maintain a pipeline of color separations for printing print jobs received from the imaging unit; and monitor the order of the color separations in the pipeline to selectively replace the ID of the empty separations in the pipeline.

18. The method of claim 13 further comprising:

receiving separations corresponding to spreads from a digital front end, DFE;

storing separations corresponding to at least two spreads; and configuring print constraints based on the stored spreads;

wherein a constraint includes inserting one or more empty separations into the color separations of a spread.

19. The method of claim 13 wherein the empty separation is a white policy empty separation performed before and after a white color separation;

wherein the next color separation is considered when selecting an ID to use in the empty separation.

* * * * *